US006837829B2

(12) United States Patent
Eschenbach

(10) Patent No.: US 6,837,829 B2
(45) Date of Patent: Jan. 4, 2005

(54) CLIMBER CROSSTRAINER EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 73 days.

(21) Appl. No.: 10/441,228

(22) Filed: May 20, 2003

(65) Prior Publication Data

US 2004/0235621 A1 Nov. 25, 2004

(51) Int. Cl.[7] ..... A63B 22/04; A63B 69/16
(52) U.S. Cl. ..... 482/52; 482/51; 482/62
(58) Field of Search ..... 482/51, 52, 53, 482/57, 62, 79, 80, 70

(56) References Cited

U.S. PATENT DOCUMENTS

| | | | | |
|---|---|---|---|---|
| 3,316,898 A | | 5/1967 | Brown | 128/25 |
| 3,814,420 A | | 6/1974 | Encke | 272/83 R |
| 4,053,173 A | | 10/1977 | Chase, Sr. | 280/253 |
| 4,561,318 A | | 12/1985 | Schirrmacher | 74/54 |
| 4,934,688 A | | 6/1990 | Lo | 272/70 |
| 4,961,570 A | | 10/1990 | Chang | 272/73 |
| 4,989,857 A | | 2/1991 | Kuo | 272/70 |
| 4,989,858 A | | 2/1991 | Young et al. | 272/70 |
| 5,013,031 A | | 5/1991 | Bull | 272/70 |
| 5,039,087 A | | 8/1991 | Kuo | 272/70 |
| 5,135,447 A | | 8/1992 | Robards, Jr. | 482/52 |
| 5,135,448 A | | 8/1992 | Dunn et al. | 482/53 |
| 5,620,400 A | | 4/1997 | Foster | 482/51 |
| 5,690,589 A | | 11/1997 | Rodgers, Jr. | 482/57 |
| 5,746,681 A | | 5/1998 | Bull | 482/53 |
| 5,759,135 A | | 6/1998 | Chen | 482/57 |
| 5,769,760 A | | 6/1998 | Lin et al. | 482/52 |
| 5,792,029 A | | 8/1998 | Gordon | 482/52 |
| 5,810,696 A | | 9/1998 | Webb | 482/52 |
| 5,938,567 A | * | 8/1999 | Rodgers, Jr. | 482/51 |
| 5,971,892 A | | 10/1999 | Lee | 482/52 |
| 6,017,294 A | | 1/2000 | Eschenbach | 482/52 |
| 6,022,296 A | | 2/2000 | Yu | 482/52 |
| 6,196,948 B1 | * | 3/2001 | Stearns et al. | 482/52 |
| 6,482,132 B2 | * | 11/2002 | Eschenbach | 482/52 |
| 6,500,099 B1 | * | 12/2002 | Eschenbach | 482/57 |

* cited by examiner

*Primary Examiner*—Stephen R. Crow

(57) ABSTRACT

The present invention relates to a standup exercise apparatus that stimulates in-place jogging and climbing with elliptical arm exercise. More particularly, the present invention relates to an exercise machine having separately supported pedals for the feet and arm exercise coordinated with the motion of the feet. A linkage is provided for each foot pedal to guide the pedal with reciprocating motion wherein the toe of the foot moves faster than the heel of the foot. A pair of cranks operably associated with the pedals provide dependent pedal motion. Handle movement is coordinated with the pedal movement for total body crosstraining. Low knee stress allows long duration exercise without hurting knees common with some crosstrainers.

17 Claims, 2 Drawing Sheets

CLIMBER CROSSTRAINER EXERCISE APPARATUS

BACKGROUND OF THE INVENTION

1. Field

The present invention relates to a standup dependent exercise apparatus that simulates jog-in-place and climbing with arm exercise that simulates rowing and ski pole motion. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides total body exercise for maximum benefit in minimum time.

Up and down foot motion has become popular in the stepper category where the heel of the foot generally moves faster than the toe. Webb in U.S. Pat. No. 5,810,696 shows a pedal linkage to guide the pedal and drive a flywheel. Bull in U.S. Pat. No. 5,746,681 and Lee in U.S. Pat. No. 5,971,892 show a pair of pedals each guided by a linkage for parallel pedal motion. Young et al. in U.S. Pat. No. 4,989,858 show independent foot support members that are pivoted forward the operator while Bull in U.S. Pat. No. 5,013,031 shows similar dependent foot support members. Robards, Jr. et al. in U.S. Pat. No. 5,135,447 offers a dependent stepper with a forward pivoted foot support member to drive an alternator.

Dunn et al. in U.S. Pat. No. 5,135,448 use forward pivoted foot support members having paddles extending beyond the pivot for water exercise. Foster in U.S. Pat. No. 5,620,400 shows dependent forward pivot foot support members connected to hand levers for mountain climbing exercise. Chang in U.S. Pat. No. 4,961,570 shows dependent forward pivoted foot support members as part of a linkage having a crank to determine step range. Lo in U.S. Pat. No. 4,934,688 shows a dependent stepper that drives a flywheel. Kuo in U.S. Pat. Nos. 4,989,857 and 5,039,087 uses forward pivoted foot support members powered by a motor through a crank.

The treadle category has the foot support members pivoted or guided rearward the operator allowing the foot to move up and down wherein the toe moves faster than the heel. Brown in U.S. Pat. No. 3,316,898 shows foot support members slidably pivoted rearward the operator with elliptical foot motion. Encke in U.S. Pat. No. 3,814,420 offers foot support members pivoted rearward the operator with treadle motion controlled by lever action. Eschenbach in U.S. Pat. No. 6,017,294 offers rearward pivoted treadle pedal movement where the heel and toe curves have the same vertical slope.

Schirrmacher in U.S. Pat. No. 4,561,318 and Chase, Sr. in U.S. Pat. No. 4,053,173 show lever power systems to drive a bicycle with rearward pivoted foot levers. Chen in U.S. Pat. No. 5,759,135 offers rearward pivoted foot support levers that telescope with crank operation. Gordon in U.S. Pat. No. 5,792,029 shows rearward pivoting foot support members that support foot trolleys for back and forth foot motion coordinated by belts to up and down foot support member motion.

Arm exercise with elliptical hand motion has recently appeared in the art. Yu in U.S. Pat. No. 6,022,296 shows a dependent stepper with elliptical hand motion. Rodgers, Jr. in U.S. Pat. No. 5,690,589 and Lin et al. in U.S. Pat. No. 5,769,760 show elliptical hand motion coordinated with elliptical foot motion.

There remains a need to combine up and down inclined foot motion having low knee stress with elliptical hand motion to exercise muscles in an alternative manner. There also remains a need for an exercise apparatus that provides climbing foot movements not found with stepper exercise apparatus.

SUMMARY OF THE INVENTION

The present invention relates to the kinematic motion control of pedals which simulate climbing during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through up and down inclined movement where the toe of the foot of an operator moves faster than the heel during the pedal cycle. The toe of the foot curve has a slope different than the heel curve. Arm exercise is by arm levers coordinated with the mechanism guiding the foot pedals.

In the preferred embodiment, the apparatus includes a pair of foot support members each having a foot engaging pedal supported by a pair of linkage that guides each pedal along inclined arcuate paths. Each linkage is comprised of a first link and a second link, each link pivotally connected to the foot support member and a frame. In the upper portion of the arcuate paths, the toe of the foot is above the heel while in the lower portion of the arcuate paths, the toe is below the heel to simulate a climbing movement.

A pair of cranks are connected to the foot support members by a pair of handle links. Rotation of the cranks causes the pedals to reciprocate up and down. Handles are attached to the handle links to provide elliptical hand movement when the cranks are rotated. Different arm exercise occurs such as rowing or ski pole movement depending upon the direction of crank rotation.

A flywheel is used with adjustable friction belt load resistance to ensure smooth motion. Of course, other forms of adjustable load resistance such as alternator, magnetic, air fan, etc. can be used in lieu of the friction belt.

In summary, this invention provides the operator with stable foot pedal support having adjustable intensity motions that simulate jog-in-place and climbing with very low joint impact while offering reversible elliptical hand motion for coordinated upper body exercise.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with additional specificity and detail through use of the accompanying drawings in which:

DETAILED DESCRIPTION OF THE EMBODIMENT

Figure 1:
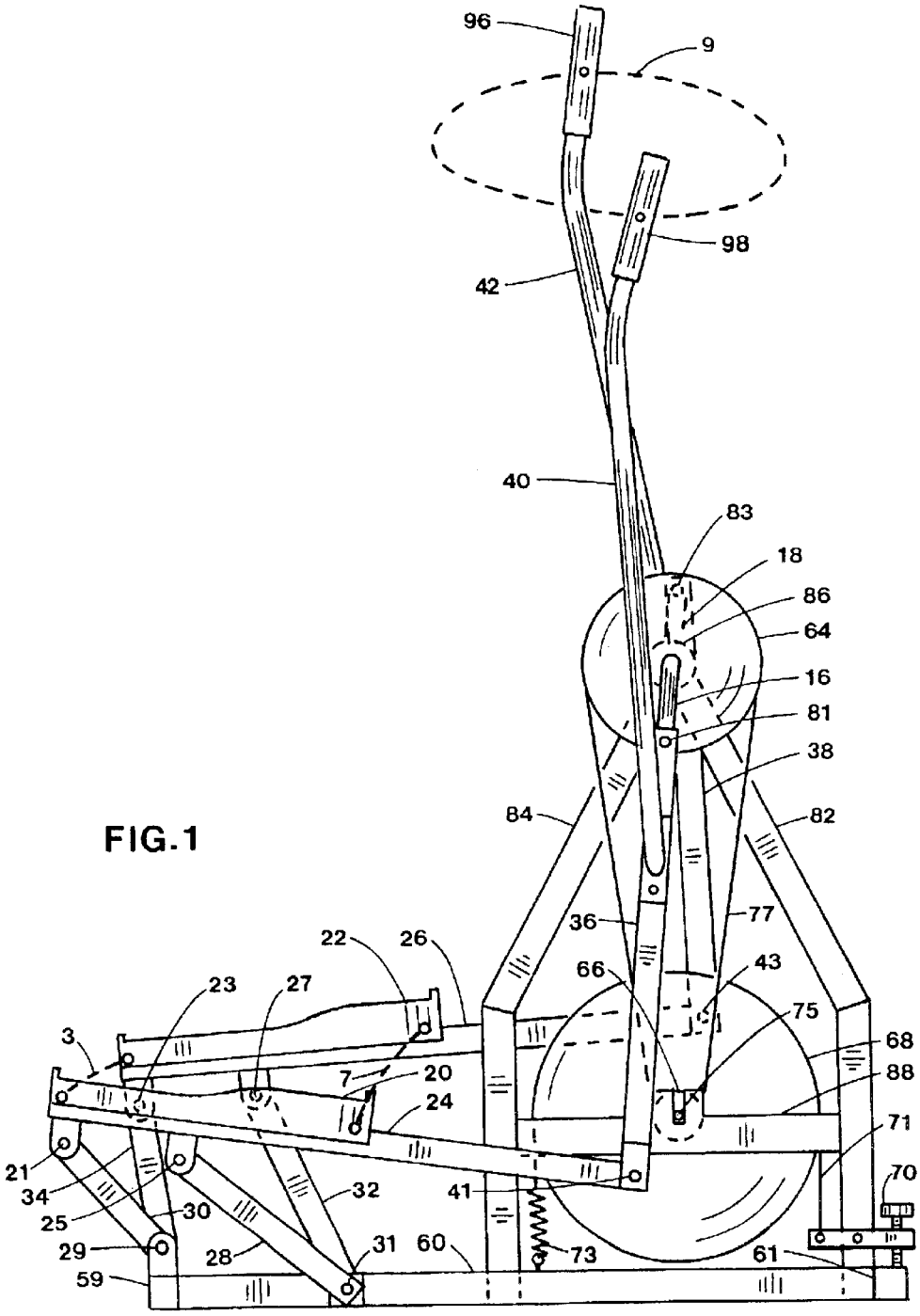
FIG. 1 is a right side elevation view of the preferred embodiment of an exercise machine constructed in accordance with the present invention.
Figure 2:
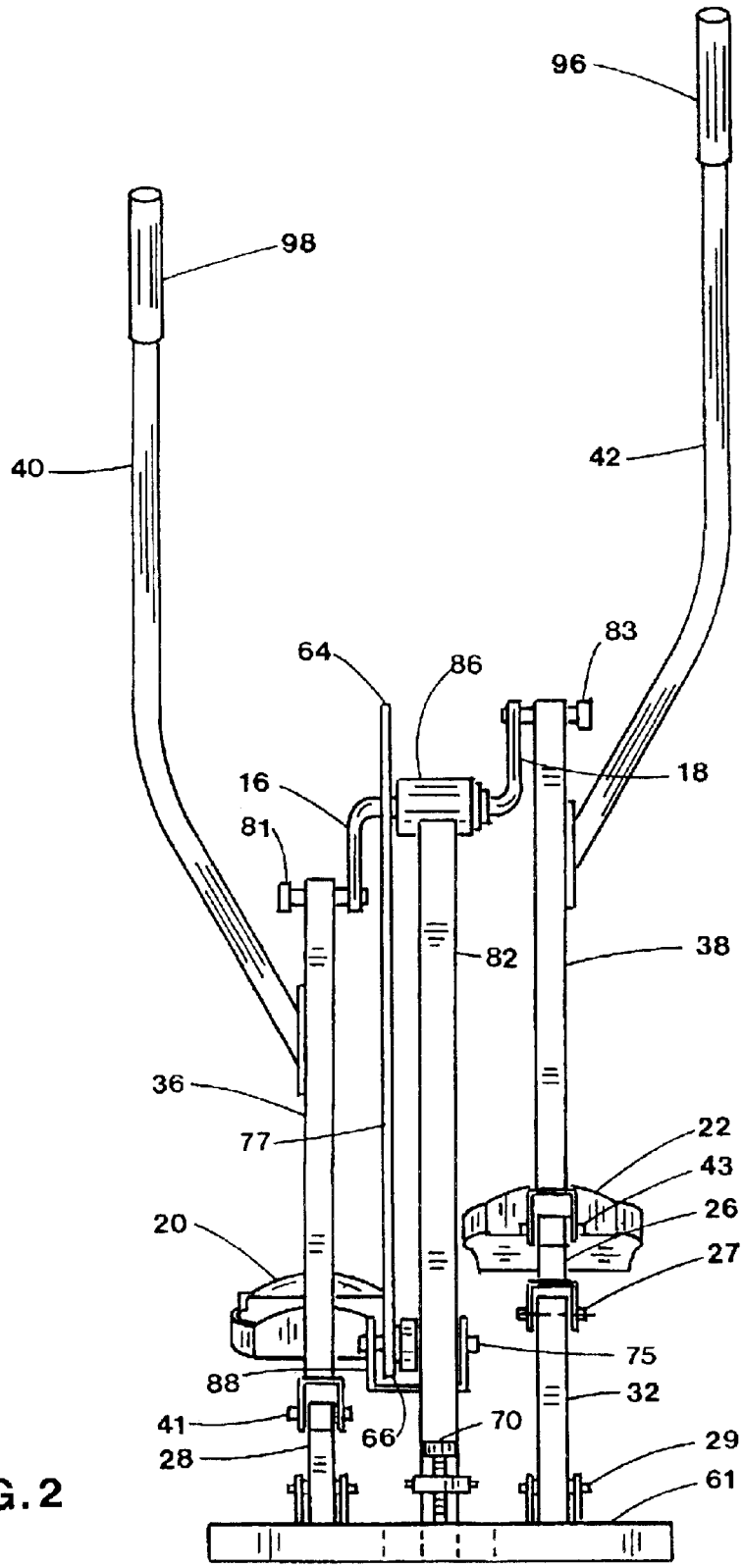
FIG. 2 is the front view of the preferred embodiment shown in FIG. 1.

Referring to the drawings in detail, pedals 20,22 are shown in FIGS. 1 and 2 in the most downward and upward positions of the preferred embodiment. Pedals 20,22 are attached to foot support members 24,26. Pedal links 30,34 are connected to foot support members 24,26 at pivots 21,23 and to frame member 59 at pivot 29. Pedal links 28,32 are connected to foot support members 24,26 at pivots 25,27 and to frame member 60 at pivots 31. Pedal links 28,30 and foot support member 24 form a first linkage to guide pedal 20 along heel path 3 and toe path 7. Pedal links 32,34 and foot support member 26 form a second linkage to guide pedal 22 along heel path 3 and toe path 7. Note that heel curve 3 is shorter than the toe curve 7 and that each curve has a different slope.

Cranks 16,18 are configured to rotate about crank bearing housing 86. Handle links 36,38 are connected to cranks 16,18 at pivots 81,83 and to foot support members 24,26 at pivots 41,43. Rotation of cranks 16,18 cause pedals 20,22 to reciprocate along heel path 3 and toe path 7. Note that the toe of the foot of the user moves faster than the heel of the foot. Handles 40,42 are attached to handle links 36,38 with hand grips 96,98 at one end of each handle 40,42. The hand grips 96,98 follow elliptical hand curve 9 as cranks 16,18 rotate.

Flywheel 68 rotates about pivot 75 and is engaged to cranks 16,18 by sprocket pair 64,66 and chain 77. Resistance is provided by strap 71 in contact with the circumference of flywheel 68 and attached to spring 73 and adjustment knob 70. Turning adjustment knob 70 varies the resistance of flywheel 68 rotation. It is understood that other forms of resistance such as magnetic, air fans, alternators, etc. may also be used.

Frame 60 is attached to frame members 59,61 which are configured to rest upon a supporting surface. Upright supports 82,84 are attached to frame 60 and join at crank bearing housing 86. Flywheel support 88 is connected to upright supports 82,84.

Handles 40,42 can be used to rotate cranks 16,18 in a clockwise manner to simulate the motion common to ski poles. A rowing motion can be simulated when the handles 40,42 are used to rotate the cranks 16,18 in a counterclockwise direction. The combination arm and foot exercise is very smooth and simulates a jog-in-place movement. An operator can use this climber crosstrainer for long periods because the knees do not hurt after extensive exercise, as is common for some users of elliptical crosstrainers.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising:

a frame, said frame configured to be supported by a supporting surface;

a pair of linkages, each said linkage comprising a plurality of links operably associated with said frame;

a pair of foot support members, each foot support member having a foot engaging pedal and being operably associated with a corresponding said linkage;

a pair of cranks, each said crank configured to rotate about a common axis connected to said frame;

a pair of handles links, each said handle link pivotally connected to a corresponding said crank and said foot support member;

each said linkage configured to guide said pedal relative to said frame with reciprocating movement along inclined arcuate non-elliptical paths as the foot of a user rotates said cranks whereby the toe of said foot is higher than the heel of said foot during the upper portion of said arcuate paths and said toe of said foot is below said heel of said foot during the lower portion of said arcuate paths.

2. The exercise apparatus according to claim 1 further comprising a pair of handles, each said handle operably associated with corresponding said handle link whereby said handle provides arm exercise.

3. The exercise apparatus according to claim 2 wherein said handle further comprises a hand grip whereby said hand grip follows an elongate curve path.

4. The exercise apparatus according to claim 1 further comprising a flywheel, said flywheel operably associated with said cranks.

5. The exercise apparatus according to claim 1 further comprising a load resistance, said load resistance operably associated with said cranks.

6. An exercise apparatus comprising:

a frame, said frame configured to be supported by a supporting surface;

a pair of linkages, each said linkage comprising a plurality of links operably associated with said frame;

a pair of cranks, each said crank configured to rotate about a common axis connected to said frame;

a pair of foot support members, each said foot support member having a foot engaging pedal and being operably associated with a corresponding said linkage and said crank;

each said linkage configured to guide said pedal relative to said frame with reciprocating movement along inclined arcuate non-elliptical paths as the foot of the user rotates said cranks whereby the toe of said foot moves faster than the heel of said foot along a portion of said arcuate paths.

7. The exercise apparatus according to claim 6 further comprising a pair of handle links, each said handle link pivotally connected to a corresponding said foot support member and said crank.

8. The exercise apparatus according to claim 7 further comprising a pair of handles, each said handle operably associated with a corresponding said handle link whereby said handle provides arm exercise.

9. The exercise apparatus according to claim 8 wherein said handle further comprises a hand grip whereby said hand grip follows an elliptical curve path.

10. The exercise apparatus according to claim 6 further comprising a flywheel, said flywheel operably associated with said cranks.

11. The exercise apparatus according to claim 6 further comprising a load resistance, said load resistance operably associated with said cranks.

12. An exercise apparatus comprising:

a frame, said frame configured to be supported by a supporting surface;

a pair of first pedal links, each said first pedal link pivotally connected to said frame;

a pair of second pedal links, each said second pedal link pivotally connected to said frame;

a pair of foot support members, each said foot support member having a foot engaging pedal and being piv otally connected with corresponding said first and said second pedal links; a pair of cranks, each said crank configured to rotate about a common axis connected to said frame and operably associated with a corresponding said foot support member;

said pedals configured to reciprocate relative to said frame along inclined arcuate paths when the foot of the user is rotating said cranks whereby the toe curve of said foot has a slope different from the heel curve of said foot.

13. The exercise apparatus according to claim 12 further comprising a pair of handle links, each said handle link pivotally connected to a corresponding said foot support member and said crank.

14. The exercise apparatus according to claim 12 further comprising a pair of handles, each said handle operably associated with said corresponding pedal whereby said handle provides arm exercise.

15. The exercise apparatus according to claim 14 wherein said handle further comprises a hand grip whereby said hand grip follows an elongate curve path.

16. The exercise apparatus according to claim 12 further comprising a flywheel, said flywheel operably associated with said pedals.

17. The exercise apparatus according to claim 12 further comprising a load resistance operably associated with said pedals.

* * * * *